US005310134A

United States Patent [19]

Hsu et al.

[11] Patent Number: 5,310,134

[45] Date of Patent: May 10, 1994

[54] TETHERED VEHICLE POSITIONING SYSTEM

[75] Inventors: Hui-Pin Hsu, Northridge; Ronald B. Chesler, Woodland Hills; Harry T. Wang, Thousand Oaks, all of Calif.

[73] Assignee: Hughes Aircraft Company, Los Angeles, Calif.

[21] Appl. No.: 851,720

[22] Filed: Mar. 16, 1992

[51] Int. Cl.[5] ..... F41G 7/32

[52] U.S. Cl. ..... 244/3.12; 342/357

[58] Field of Search ..... 244/3.12; 342/357

[56] References Cited

U.S. PATENT DOCUMENTS

| | | | |
|---|---|---|---|
| 4,860,968 | 8/1989 | Pinson | 244/3.12 |
| 4,907,763 | 3/1990 | Pinson | 244/3.12 |
| 5,035,375 | 7/1991 | Friedenthal et al. | 244/3.12 |
| 5,144,318 | 9/1992 | Kishi | 342/357 |
| 5,148,452 | 9/1992 | Kennedy et al. | 342/357 X |

*Primary Examiner*—Harold J. Tudor

*Attorney, Agent, or Firm*—Randall M. Heald; Charles D. Brown; Wanda K. Denson-Low

[57] ABSTRACT

A tethered vehicle such as a missile system comprises a tethered vehicle body having a control system and propulsion system therein, a control station for the tethered vehicle located outside of the tethered vehicle body, and an optical fiber data link extending from the tethered vehicle control system to the control station. The tethered vehicle system further includes a GPS positioning system for the tethered vehicle, which comprises a positioning signal receiving antenna mounted in the tethered vehicle, and a positioning signal amplifier mounted in the tethered vehicle, which receives a positioning signal from the antenna and produces an amplified positioning signal. A transmitter transmits the amplified positioning signal into the optical fiber data link at its end within the tethered vehicle, and a receiver receives the amplified positioning signal from the optical fiber data link at its end at the control station. A signal processor analyzes the amplifier positioning signal received from the receiver. The signal processor is located at the control station. Preferably, there is imposed a time-shift correction to the positioning signal to negate the effect of the separation between the antenna and the signal processor.

13 Claims, 2 Drawing Sheets

TETHERED VEHICLE POSITIONING SYSTEM

BACKGROUND OF THE INVENTION

This invention relates to tethered vehicles such as optical fiber guided missiles, and, more particularly, to the determination of the absolute location of such tethered vehicles.

Tethered vehicles are used in a variety of civilian and military missions. Such a tethered vehicle typically includes a self-propelled, unmanned vehicle that is linked to a central control station by a wire or optical fiber data link. Information is transmitted from the vehicle to a controller along the data link, and control signals are transmitted from the controller to the vehicle along the same data link. Examples of such tethered vehicles include missiles, boats, torpedoes, certain spacecraft, and explorer and salvage units. Optical fiber guided missiles are of the most interest to the present inventors, and will be discussed in greatest detail herein, but the present approach is applicable to other types of tethered vehicles as well.

An optical fiber guided missile system includes a missile, a control station, and an optical fiber data link extending between the missile and the control station. The missile is usually launched from the vicinity of the control station, which may be a fixed or mobile ground site or an aircraft. The optical fiber is initially wound onto a bobbin in the missile (or one bobbin in the missile and another at the launch site) and payed out from the missile as the missile flies. Optical fibers used in such missile systems are typically 5–30 kilometers in length or even longer in some cases, defining the radius of operation of the missile from its launch site. Optical fiber guidance has the important advantage over other types of guidance systems that it is highly resistant to jamming and other interference, and can bidirectionally transmit large quantities of information simultaneously from and to the missile.

As the missile flies through the air, a sensor such as a visible-light television camera or an infrared seeker produces a picture of the terrain. The picture is transmitted back to the control station on the optical fiber data link, where the operator or an electronic tracker uses the picture in selecting targets, performing reconnaissance, or other missions. Control signals are transmitted back along the optical fiber to the missile from the control station, responsive to the commands of the operator or tracker.

For many missions the absolute position of the missile must be known, particularly where the radius of operation takes the missile to great distances from the control station. In one type of mission, for example, the missile may initially fly at low speeds at various altitudes and headings to gather reconnaissance data and then, after identifying the target, switch to a higher speed attack at a previously defined location. When flying such a mission profile in the confusion of the battlefield environment, the operator or tracker may lose track of absolute position of the missile with respect to the control station, interfering with the targeting procedure and reducing the value of the data gathered during the reconnaissance phase.

It is therefore important to be able to determine the position of the optical fiber guided missile. Visual and radar methods cannot be relied upon, because the missile may be outside the line of sight and because the radar returns may be unavailable or unreliable when the missile is flying at a low altitude. Relative position of the missile calculated from heading and speed information may provide an approximation of the absolute position data, but there is always a substantial degree of uncertainty of the missile position computed in this way.

Another possible solution is to use the global positioning system (GPS) to determine the absolute position of the missile. GPS provides an array of satellites that transmit positioning signals. The position of a receiver of those signals can be determined by a ranging method, wherein the position is uniquely determined by the range of the receiver to three, four, or more satellite transmitters.

The use of GPS in an optical fiber guided missile is made complex by the need to establish the position of the missile very accurately and very rapidly, while working within the missile constraints of low weight and acceptable cost. A variety of GPS receivers are available. The faster, more accurate GPS receivers tend to be heavy and costly, while the lighter, less costly GPS receivers cannot make position determinations rapidly enough to be of tactical value. Many existing GPS signal processing units also cannot stand the demanding operational environments experienced by a missile.

There remains a need for a tethered vehicle positioning system operable with an optical fiber guided tethered vehicle. The present invention fulfills this need, and further provides related advantages.

SUMMARY OF THE INVENTION

The present invention provides an optical fiber guided tethered vehicle system having a positioning system that permits the absolute location of the tethered vehicle to be determined accurately and rapidly. The positioning system does not add greatly to the weight of the tethered vehicle, nor have a significant effect on its performance. The cost of the system per tethered vehicle is relatively low, while simultaneously achieving excellent results even when the tethered vehicle is operating under highly adverse conditions.

In accordance with the invention, a tethered vehicle system comprises a tethered vehicle body having a control system and propulsion system therein, a control station for the tethered vehicle located outside of the tethered vehicle body, and an optical fiber data link from the tethered vehicle control system to the control station. The control station is usually at the launch site of the tethered vehicle, whether that be a stationary, land-mobile, or air-mobile location. The tethered vehicle system further includes a positioning system for the tethered vehicle. The positioning system includes a positioning signal receiving antenna mounted in the tethered vehicle and a positioning signal amplifier mounted in the tethered vehicle. The amplifier receives a positioning signal from the antenna and produces an amplified positioning signal. The positioning system further includes means for transmitting the amplified positioning signal into the optical fiber data link at its end within the tethered vehicle and means for receiving the amplified positioning signal from the optical fiber data link at its end at the control station. Signal processing means located at the control station analyzes the amplified positioning signal received from the means for transmitting.

This positioning system places the positioning antenna in the tethered vehicle, and the signal processing system and electronics at the control station. The positioning antenna receives a positioning signal from an external source and encodes that signal onto a light beam transmitted from the tethered vehicle to the control station through the optical fiber. An important advantage of optical fiber communication is that the light signal may be modulated to communicate information at high data rates in both directions simultaneously, using different optical wavelengths. The information of the positioning signal from the external source is readily encoded onto the light beam transmitted through the optical fiber, without interfering with other signals transmitted on the optical fiber.

The present system is compatible with the use of positioning signals transmitted by the NAVSTAR or the GLONASS global positioning systems (GPS), or other global positioning systems that might later be developed. Using GPS, the position of an object on or above the earth is determined by finding its distance from three or more satellites in orbit above the earth. The accuracy of the position determination depends greatly on the sophistication and operating speed of the electronic signal processing equipment used to analyze the information received by the positioning signal receiving antenna. For example, for stationary or very slowly moving objects or objects whose position need not be known with great precision, the use of positioning information from three satellites may be sufficient. For a tethered vehicle that requires very accurate position determination in a hostile environment, generally information from four satellite signals is preferred.

Placing the signal processing means at the control station rather than in the tethered vehicle permits the use of complex, high-speed processors to analyze the positioning signals received from the external source. Placing such processors in the tethered vehicle is not feasible, primarily due to the size, power requirements, and operating environment requirements of the processors, and to the cost of the more sophisticated processors. Because the tethered vehicle is unmanned, it can operate with accelerations and in hostile electromagnetic battlefield environments that would not permit operation of some processors. Placing the signal processor at the control station removes it from the hostile environment and avoids the need for operational restrictions on the tethered vehicle and added weight and size requirements on the tethered vehicle. The placement of the signal processor at the control station also reduces the disposable cost of the tethered vehicle, by permitting the signal processor to be reused for many tethered vehicle operations. A more complex signal processor, for example one that uses a more accurate synchronization clock than possible with a unit that fits inside a tethered vehicle, can be provided.

Separation of the signal processing from the antenna introduces complexities into the positional determination that must be solved, for those cases where the position determination is based upon precise distance measurement from external sources. The GPS system uses this approach, transmitting synchronized signals from a number of satellites that are received by the positioning signal receiving antenna. The time of flight of the radio wave from the satellite times the speed of light is the distance of the antenna from that particular satellite. These determinations are very precise, and the error introduced by the time required to transmit the positioning signal from the tethered vehicle to the control station through the optical fiber data link can introduce a systematic error into the determination of position. Many sophisticated GPS signal processors have built-in analysis routines to negate systematic errors. However, convergence of the solutions to the actual location may be too slow to be useful in the case of a missile flying at varying speeds over a battlefield.

To achieve a faster convergence of the position determination, in a preferred embodiment of the present invention there is a means for modifying the positioning signal with a time displacement to account for the transmission time through the optical fiber data link. This time displacement is preferably a constant value for all of the received satellite signals, equal to the time required for the light signal to pass through the length of the optical fiber. The modification to the time signal has the effect of causing the signal processor to operate as though it were at the tethered vehicle rather than separated from it.

The present invention provides an important advance in the art of tethered vehicle systems. The absolute position of a tethered vehicle may be determined very accurately, while the tethered vehicle operates at high speeds in a hostile environment. Other features and advantages of the invention will be apparent from the following more detailed description of the invention, taken in conjunction with the accompanying drawings, which illustrate, by way of example, the principles of the invention.

DETAILED DESCRIPTION OF THE INVENTION

Figure 1:
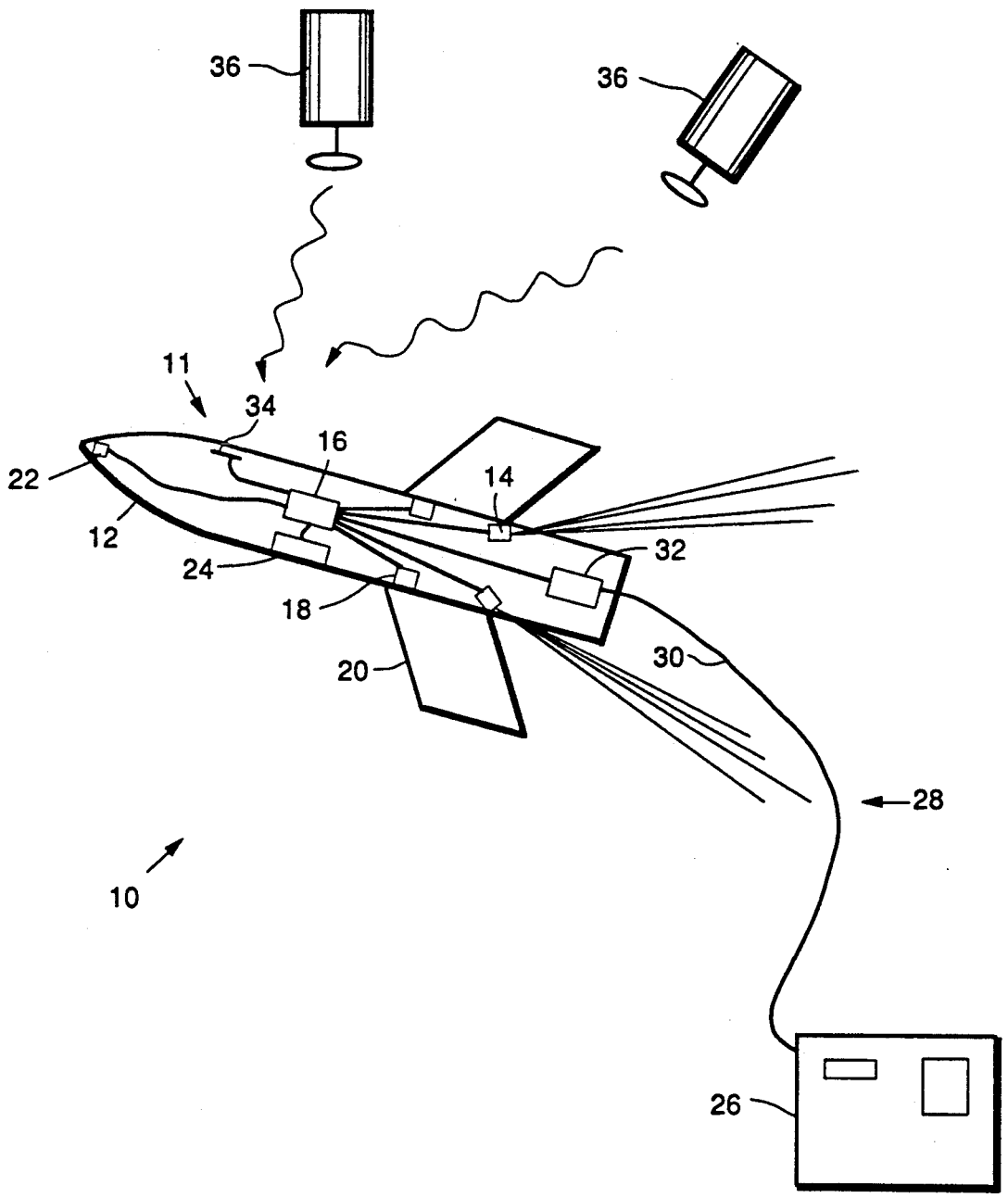
FIG. 1 is a schematic perspective view of a missile system.

FIG. 1 illustrates a missile system 10, the preferred form of the tethered vehicle system of the invention, that includes a missile 11 having a missile body 12 with two propulsion rocket motors 14 mounted therein. A control unit 16 sends commands to the rocket motors 14 (where the rocket motors are of the controllable type) and to control surface actuators 18 that move all or part of control surfaces 20 that extend outwardly from the missile body 12. The control unit 16 receives inputs from a television camera 22 in the nose of the missile body 12, or, equivalently, a radar or infrared seeker. The control unit 16 receives inputs from other sensors, collectively indicated at numeral 24, that sense air speed, missile orientation, acceleration, engine performance, and other operating information about the missile 11.

A positioning signal receiving antenna 34 mounted within the missile body 12 receives a positioning signal from an external source. A positioning signal is conveyed from the antenna 34 to the control unit 16. In the preferred case of a positioning signal transmitted from satellites 36 of the global positioning system, the antenna 34 is an L-band antenna that receives at 1.5 GHz (gigahertz) and 1.2 GHz frequencies. The processing of the positioning signal will subsequently be discussed in greater detail in relation to FIG. 2.

The control unit 16 communicates with a control station 26 which is not located within the missile body 12. The control station 26 is normally located at the launch site of the missile 11. The launch site may be an aircraft (either fixed wing or helicopter), a fixed ground station, ground-mobile launcher, naval ship, or other suitable location. The control station 26 is placed at the launch site, or other suitable location, and is typically manned by a human operator or under computer control.

The control unit 16 communicates with the control station 26 through an optical fiber data link 28. The optical fiber data link 28 includes an optical fiber 30 that is connected at one end to the control unit 16 and at the other end to the control station 26. The optical fiber 30 is initially wound upon a bobbin in a canister 32, prior to launch of the missile 11. The canister 32 is placed in the missile body 12. Where the launch site is a rapidly mobile launch vehicle, such as an aircraft, there may be a second canister within the launch vehicle such that the optical fiber 30 is dispensed from both canisters simultaneously.

Figure 2:
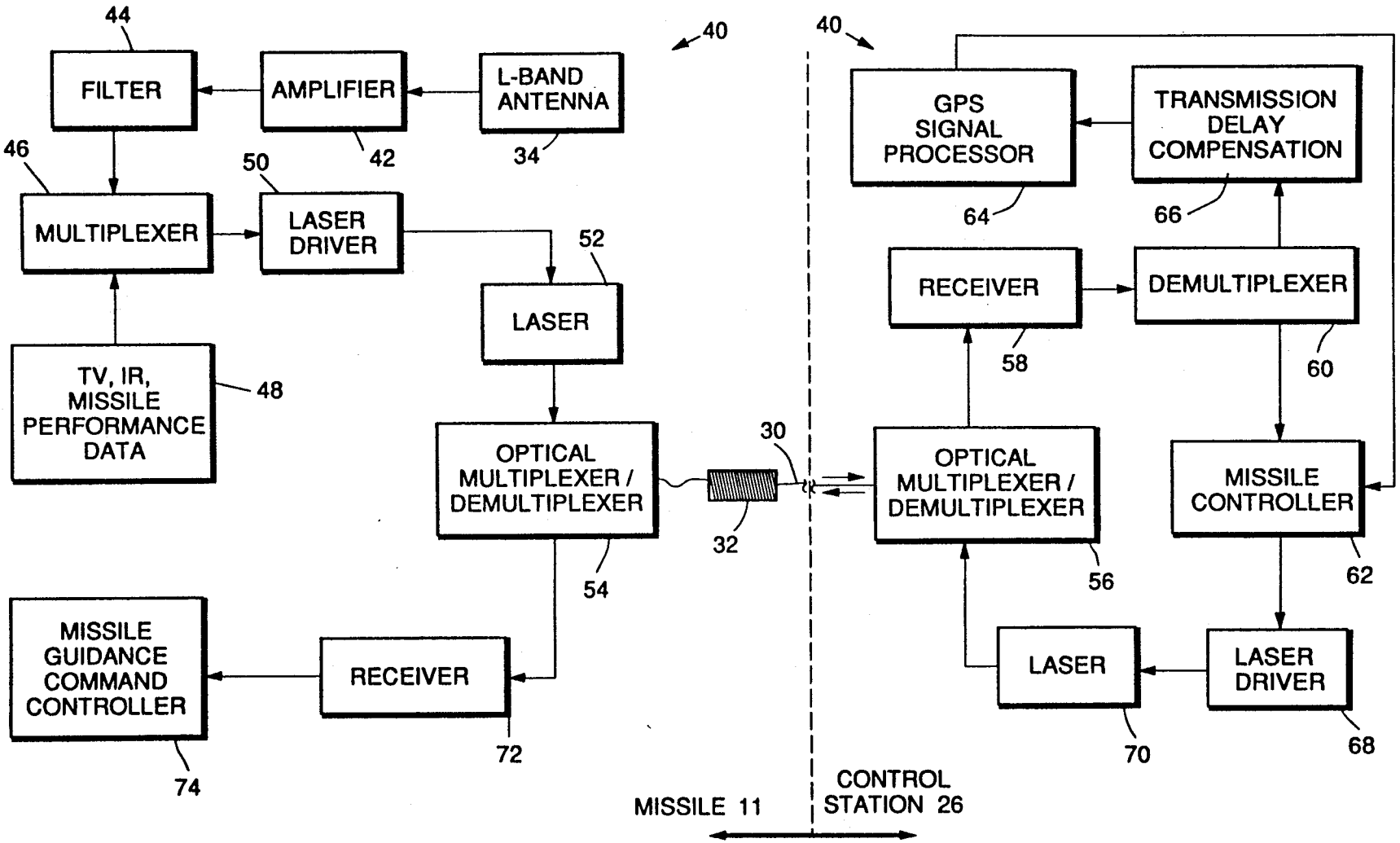
FIG. 2 is a block diagram of the data flow of the missile system.

FIG. 2 illustrates in block diagram form a positioning system 40 and its relation to the missile control system. Positioning signals are received at the antenna 34, which in the preferred case is an L-band antenna that receives signals from the GPS at frequencies currently selected as 1.5 GHz and 1.2 GHz. The signal received by the antenna 34 is amplified by an amplifier 42 to a usable level. The amplified signal is filtered by a filter 44, which is preferably a band-pass filter that passes the desired L1 frequency of 1.5 GHz and the desired L2 frequency of 1.2 GHz and a small range of frequencies adjacent to those frequencies. Other signals are rejected.

The filtered positioning signal is multiplexed onto a single transmission band by a multiplexer 46 with other signals relating to missile performance and operation, and surveillance functions, to be sent to the control station 26. These other signals generally are represented at numeral 48, and include the feed from the TV camera 22, signals from the sensors 24, diagnostic information, and other performance, control, or information signals that are selected for transmission to the control station 26. In this preferred embodiment, all of the signals are transmitted to the control station 26 in analog form.

The electrical signal from the multiplexer 46 is converted to a laser driver signal of a first wavelength by a laser driver 50. The laser driver signal drives a laser 52 or other light source that is coupled to the optical fiber 30 through an optical multiplexer/demultiplexer 54. The optical multiplexer/demultiplexer 54 acts as the gate at the missile end of the optical fiber data link 28 to separate outgoing from incoming signals.

The light signal from the optical multiplexer/demultiplexer 54 passes through the optical fiber 30 to another optical multiplexer/demultiplexer 56 at the control station 26, which separates the incoming from the outgoing optical signals. The signals incoming to the control station 26 from the missile 11 are sensed by a photosensitive device in a receiver 58 and converted to an electrical signal. Equivalently, in future systems the additional signal processing might utilize optical circuits rather than electrical circuits, and in that event the incoming signals would not be converted to electrical signals.

The incoming signals from the missile 11 contain all of the transmitted information from the missile 11. The signals are separated by a de-multiplexer 60. Signals related to missile control and operation are directed to a missile controller 62, and positioning signals are directed to a GPS signal processor 64. The technology used in such signal processors 64 is known in the art and is commercially available. Such signal processors are available commercially or may be constructed by those skilled in the art from the available information with a variety of processing capabilities and speeds. Normally, with the present approach a sophisticated, high speed GPS signal processor that processes positioning signals from four satellite channels is used. Briefly, the GPS signal processor determines the time required for the signal broadcast from each satellite 36 to reach the antenna 34. The absolute position of the antenna 34 is uniquely fixed from that information. A variety of analysis circuits are available to correct for disparity in clock synchronization between the satellite and the signal processor, variations in atmospheric characteristics, and other errors and phenomena. With the available global positioning system and signal processors, absolute locations accurate to within about +/−10 meters may be made routinely. The position information is provided to the missile controller 62.

The present invention permits a sophisticated signal processor 64 to be used, because the signal processor is located in the control station 26 rather than in the missile 11. If the signal processor were located in the missile, its selection would be far more tightly constrained by size, weight, power consumption, and cost considerations, which in turn would reduce the expected performance of the signal processor. GPS signal processors are available in a variety of degrees of sophistication, ranging from slow, two-channel types to fast, five-channel types with advanced signal processing components and analytical routines of the types discussed previously. The systems with less capability are unacceptable for use in missile applications, because they cannot process the positional information sufficiently rapidly to be of use for many missile requirements.

One systematic error is known to be present in the positioning system 40 and can be negated through the use of a transmission delay compensator 66. The absolute location of the missile 11 is to be determined, and the antenna 34 is located on the missile. However, the positioning signal is transmitted from the antenna 34 to the GPS signal processor 64 through a length of electrical wiring and, most significantly, a length of optical fiber data link that may be 5–30 kilometers or more in length. The positioning analysis done at the GPS signal processor will be modified because of the added transmission delay of this data path. Many GPS units have a built-in correction facility for the purpose of correcting for clock errors, and the built-in correction facility may in some cases be capable of correcting for the length of the optical fiber data link. However, convergence of the analysis to the correct position is slowed by the need to compensate for the length of the optical fiber data link.

The preferred approach of the present invention therefore provides for applying a time shift to the positioning signal data at the transmission delay compensator 66. The transmission delay compensator 66 may be a hardware or software unit, but in either case acts to compensate the signals for the total length of the optical fiber data link. The length of electrical circuit paths may also be included in the compensation.

The amount of time-shift correction to be applied to the positioning signal is determined by dividing the total length of the optical fiber data link (plus electrical path, if desired), from the antenna 34 to the signal processor 64 by the speed of light. This small number is subtracted from the time index of the positioning signal as received at the signal processor 64, to provide a time signal corresponding to the moment when the positioning signal was received by the antenna 34. This signal is then processed in the normal way by the signal processor 64, to determine the absolute position of the antenna 34.

The remainder of the structure depicted in FIG. 2 relates to the control of the missile, not the positioning system, but will be described for completeness. The missile controller 62, which usually includes a video display for the operator and missile controls, as well as other processing capability, is used to analyze the visual and performance information received from the missile 11 and generate commands for action by the missile 11. The commands are generated in electrical form, and provided to a laser driver 68 comparable in function to the laser driver 50. The laser driver 68 converts the electrical command signals to a modulated form for driving a laser 70.

The laser 70 is comparable in function to the laser 52, except that the two normally are selected to operate on different optical wavelengths to avoid interference between the incoming and outgoing signals. The light output of the laser 70 is directed through the optical multiplexer/demultiplexer 56 and into the optical fiber 30 for transmission to the missile 11.

The optical signal conveyed along the optical fiber 30 from the control station 26 to the missile 11 is received by the optical multiplexer/demultiplexer 54, and directed to a receiver 72 comparable in function to the receiver 58. The receiver 72 generates an electrical signal output responsive to the commands of the missile controller 62, and directs them to a missile guidance command controller 74 within the control unit 16. The controller 74 generates the operating commands to the rocket motors 14, actuators 18, and other controllable structure of the missile 11.

The present invention provides an important advance in the art of missile systems. Advanced positioning signal processors can be used to determine the position of a missile, without adding to the weight, size, and power consumption of the missile, and while using advanced signal processing techniques. Although a particular embodiment of the invention has been described in detail for purposes of illustration, various modifications may be made without departing from the spirit and scope of the invention. Accordingly, the invention is not to be limited except as by the appended claims.

What is claimed is:

1. A tethered vehicle system, comprising:

a tethered vehicle body having a control system and propulsion system therein;

a control station for the tethered vehicle located outside of the tethered vehicle body;

an optical fiber data link from the tethered vehicle control system to the control station;

a positioning system for the tethered vehicle, the positioning system comprising a positioning signal receiving antenna mounted in the tethered vehicle, a positioning signal amplifier mounted in the tethered vehicle, the amplifier receiving a positioning signal from the antenna and producing an amplified positioning signal, means for transmitting the amplified positioning signal into the optical fiber data link at its end within the tethered vehicle, means for receiving the amplified positioning signal from the optical fiber data link at its end at the control station, and signal processing means for analyzing the amplified positioning signal received from the means for transmitting, the signal processing means being located at the control station.

2. The tethered vehicle system of claim 1, wherein the antenna is an L-band antenna.

3. The tethered vehicle system of claim 1, wherein the signal processing means includes a global positioning satellite signal processor.

4. The tethered vehicle system of claim 1, further including means for modifying the positioning signal with a time displacement.

5. The tethered vehicle system of claim 1, wherein the tethered vehicle is a missile.

6. A missile system, comprising:

a missile body having a control system and propulsion system therein;

a control station for the missile located outside of the missile body;

an optical fiber data link from the missile control system to the control station;

a positioning system for the missile, the positioning system comprising a positioning signal receiving antenna mounted in the missile, means for transmitting the positioning signal into the optical fiber data link at its end within the missile, means for receiving the positioning signal from the optical fiber data link at its end at the control station, and signal processing means for analyzing the amplified positioning signal received from the means for transmitting, the signal processing means being located at the control station and including means for introducing a time displacement into the positioning signal.

7. The missile system of claim 6, wherein the antenna is an L-band antenna.

8. The missile system of claim 6, wherein the signal processing means includes a global positioning satellite signal processor.

9. The missile system of claim 6, wherein the signal processing means includes a transmission delay compensator.

10. A missile system, comprising:

a missile body having a control system and propulsion system therein;

a control station for the missile located outside of the missile body;

an optical fiber data link from the missile control system to the control station;

a positioning system for the missile, the positioning system comprising a positioning signal receiving antenna mounted in the missile, a positioning signal amplifier mounted in the missile, the amplifier receiving a positioning signal from the antenna and producing an amplified positioning signal, means for mixing the amplified positioning signal with information produced by the control system of the missile and for encoding the mixed signal into a light beam transmitted into the optical fiber data link, the means for mixing being located in the missile, means for decoding the mixed signal from the light beam and for demixing the amplified positioning signal from the information produced by the control signal of the missile, the means for decoding and demixing being located at the control station, and signal processing means for receiving and analyzing the amplifier positioning signal transmitted on the optical fiber, the signal processing means being located at the control station and including means for introducing a time displacement into the positioning signal.

11. The missile system of claim 10, wherein the antenna is an L-band antenna.

12. The missile system of claim 10, wherein the signal processing means includes a global positioning satellite signal processor.

13. The missile system of claim 10, wherein the signal processing means includes a transmission delay compensator.

* * * * *